United States Patent [19]

Göttel

[11] 4,141,389

[45] Feb. 27, 1979

[54] WIRE-FASTENING MECHANISM

[76] Inventor: Heinz Göttel, Am Boksberg 10, 3203 Sarstedt, Fed. Rep. of Germany

[21] Appl. No.: 870,061

[22] Filed: Jan. 17, 1978

[30] Foreign Application Priority Data

Sep. 24, 1977 [DE] Fed. Rep. of Germany ..... 2743105

[51] Int. Cl.[2] ..... B21F 45/00

[52] U.S. Cl. ..... 140/93 A; 93/91; 140/101; 140/113

[58] Field of Search ..... 40/20 R; 93/87, 91; 140/93 R, 93 A, 92.94, 101, 113

[56] References Cited

U.S. PATENT DOCUMENTS

| | | | |
|---|---|---|---|
| 876,573 | 1/1908 | Myers | 140/101 |
| 1,458,444 | 6/1923 | Scott | 40/20 R |
| 2,081,285 | 5/1937 | Travis | 93/91 |

FOREIGN PATENT DOCUMENTS 393968 4/1924 Fed. Rep. of Germany.

*Primary Examiner*—E. M. Combs

*Attorney, Agent, or Firm*—Larson, Taylor and Hinds

[57] ABSTRACT

A wire-fastening mechanism has a wire shaping and guiding device and a pivoted hook-shaped needle which co-operate together to fasten a wire to a connector lug by forming a cross loop of wire through a triangular formation of apertures in the lug. The wire shaping and guiding device has two opposed members between which the lug is inserted. Wire guiding grooves are provided in the opposed members to define one and a half turns of a helical channel around which wire is pushed to thread the aperture lugs as the wire passes between wire guiding grooves of the opposed members. The hook-shaped needle receives the leading end of the wire after it has passed through the triangular formation of apertures. Pivoting of the needle draws the leading wire end beneath a run of the wire between two of the apertures thereby to form a cross loop of wire.

8 Claims, 12 Drawing Figures

WIRE-FASTENING MECHANISM

FIELD OF THE INVENTION

This invention relates to a wire-fastening mechanism for fastening a wire to a connector lug by forming a loop of wire through a triangular formation of apertures in the lug.

SUMMARY OF THE INVENTION

According to one aspect of the invention, there is provided a wire-fastening mechanism for fastening a wire to a connector lug by forming a cross loop of wire through a triangular formation of apertures in the lug, said mechanism comprising: a support structure, a hook-shaped needle pivotally mounted on the support structure and provided with an eye, and a wire shaping and guiding device mounted on the support structure adjacent said needle, the said device comprising a first member defining a first wire-guiding groove having entry and exit ends, a second member defining second and third wire-guiding grooves with respective entry and exit ends, said members being arranged in spaced opposition and said second, first and third grooves constituting successive half turns of a helical guide channel for wire to be formed into a coil in said device, said second groove being arranged to receive at its entry end wire to be formed into the coil, the first and second members being spaced from each other enabling the connector lug to be positioned therebetween with the apertures of said triangular formation of apertures respectively aligned between the exit end of said second groove and the entry end of the first groove, between the exit end of the first groove and the entry end of the third groove, and with the exit end of the third groove whereby wire formed into a coil by passage along said grooves is passed through the connector lug apertures, said needle being pivotable to a position between said members in which its eye is aligned with the exit end of said third groove whereby to receive the wire end emerging therefrom after passage through the corresponding aperture lug and pull that wire beneath the wire portion in said first groove to form a cross loop of wire.

According to another aspect of the invention, there is provided a wire-fastening mechanism for fastening a wire to a connector lug by forming a cross loop of wire through a triangular formation of apertures in the lug, said mechanism comprising: a support structure, a hook-shaped needle pivotably mounted on the support structure and provided with an eye, and a wire shaping and guiding device mounted on the support structure adjacent said needle, the said device comprising a first member defining a first wire-guiding groove having entry and exit ends, a second member defining second and third wire-guiding grooves with respective entry and exit ends, said members being arranged in spaced opposition and said second, first and third grooves constituting successive half turns of a helical guide channel for wire to be formed into a coil in said device, said second groove being arranged to receive at its entry end wire to be formed into the coil, and a guiding element seated in said second member to facilitate guiding of the wire around the second and third grooves, the arrangement of the first and second members and the guiding element being such that the connector lug can be positioned therebetween with the apertures of said triangular formation of apertures respectively aligned between the exit end of said second groove and the entry end of the first groove, between the exit end of the first groove and the entry end of the third groove, and with the exit end of the third groove whereby wire formed into a coil by passage along said grooves is passed through the connector lug apertures, said needle being pivotable to a position between said members in which its eye is aligned with the exit end of said third groove whereby to receive the wire end emerging therefrom after passage through the corresponding aperture lug and pull that wire end beneath the wire portion in said first groove to form a cross loop of wire.

BRIEF DESCRIPTION OF THE DRAWINGS

A wire-fastening mechanism embodying the invention and for fastening a wire to a connector lug by forming a cross loop of wire through a triangular formation of apertures in the lug, will now be particularly described, by way of example, with reference to the accompanying diagrammatic drawings, in which.

DESCRIPTION OF THE PREFERRED EMBODIMENT

The wire-fastening mechanism now to be described is arranged to fasten a wire to a connector lug (FIG. 12) by forming a cross loop of wire through apertures 2, 3 and 4 in the lug; by "cross-loop" is meant a loop in which the tails of the loop cross each other to press against on another during use and thereby provide a measure of security against accidental release. The apertures 2 to 4 in the connector lug 1 are situated at the apices of a triangle which in the present example is an equilateral triangle. The manner of formation of the apertures 2 to 4 and of feed of the connector lug 1 to the wire-fastening mechanism will not be described herein as they do not form part of the present invention and suitable methods are known.

Figure 1:
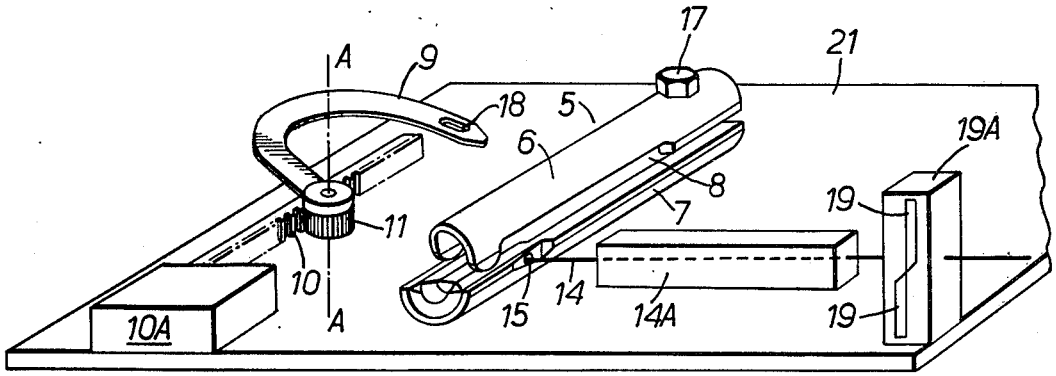
FIG. 1 is a perspective view showing a wire shaping and guiding device and a pivotable hook-shaped needle of the mechanism.

As shown in FIG. 1, the wire-fastening mechanism comprises the wire shaping and guiding device 5 which coils, that is helically shapes, a wire 14 fed to it and guides threading of the wire through the perforations 2 to 4 of the connector lug 1. The device 5 is mounted on a support structure 21 and has an upper member 6 and a lower member 7, a slot 8 being provided between these two members 6 and 7 for receiving part of the pivotal hook-shaped needle 9 which is turnable about its pivot axis A—A by a rack and pinion gearing 10 and 11 driven by a drive unit 10A. This rack and pinion gearing 10 and 11 comprises a rack 10 meshing with a pinion 11 which is formed integral with the needle 9 and is axially aligned with the pivot axis A—A of the hook-shaped needle 9. The needle 9 has an eye 18.

Figure 2:
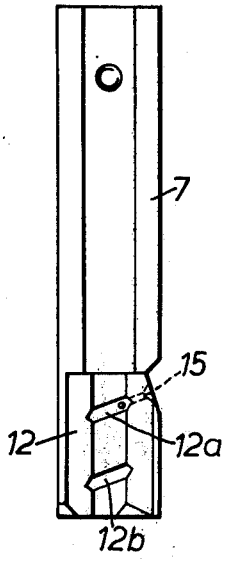
FIG. 2 is a plan view of a lower member of the wire shaping and guiding device.

A shaped element 12 (FIG. 2) is incorporated in the lower member 7 of the device 5. In the element 12 are machined two guiding grooves 12*a* and 12*b* which extend in a direction corresponding to the direction of the turns of the coil which is to be formed from the wire 14.

The lower member 7 also has an aperture 15 which opens into the guiding groove 12*a* and through which the wire 14 is fed in the groove 12*a*.

Figure 3:
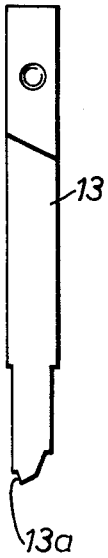
FIG. 3 is a plan view of a guiding member of the wire shaping and guiding device.

The lower member 7 is also arranged to receive a guiding member 13 (FIG. 3) of semi-circular cross-section around whose convex surface the wire 14 extends during the forming of a wire coil. The guiding member 13 has at one end a guiding surface 13*a* which ensures that the leading end portion of the wire coil to be formed by the device 5 has imparted to it the correct direction needed for threading the wire through the lug 1.

Figure 5:
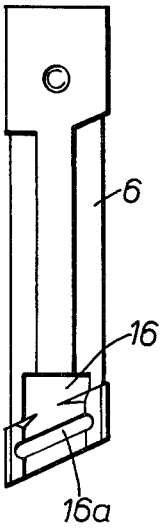
FIG. 5 is a plan view of an upper member of the wire shaping and guiding device.

The upper member 6 also incorporates a shaped element 16 (FIG. 5) in which a guiding groove 16*a* is machined to match the direction of the turns of the wire coil which is to be formed.

Figure 6:
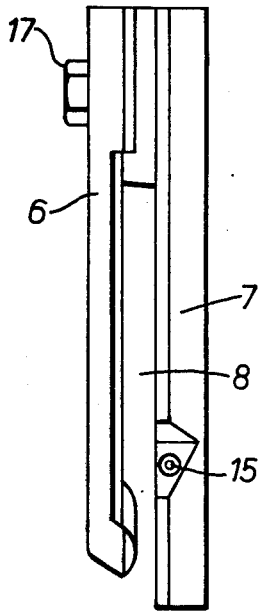
FIG. 6 is a side view of the wire shaping and guiding device.

The lower member 7, the upper member 6 and the guiding member 13 are bolted to each other at their end portions away from the part of the device 5 where the wire coil is to be formed, by means of a bolt 17 (FIG. 6). With the device 5 assembled, the guiding grooves 12*a*, 16*a* and 12*b* form successive turns of a helical guide channel for wire to be formed into a coil in the device 5.

The wire-fastening mechanism also has a wire-severing device 19A provided with blades 19 for severing the wire 14.

Figure 4:
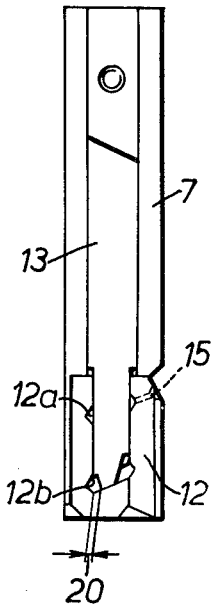
FIG. 4 is a plan view of the two parts shown in FIGS. 2 and 3 assembled together.

A gap 20 (FIG. 4) through which the wire emerges in a tangential direction of the device 5 is defined between the shaped element 12 and the guiding member 13 above one end of the guiding groove 12*b*. Operation of the wire-fastening mechanism will now be described.

The wire 14 is fed to the device 5 by means 14*a* comprising, for example, a pair of rollers which push the wire 14 into aperture 15 and on into the guiding groove 12*a* in the lower member 7 of the device 5.

Following this, the wire 14 passes through the guiding groove 16*a* in the upper member 6 and from there enters the guiding groove 12*b* of the lower member 7. In this manner the wire 14 is formed into a coil. The guiding surface 13*a* ensures that the leading end of the wire coil thus formed has imparted to it the correct direction required for insertion into the individual apertures 2 to 4 of the connector lug 1.

Figure 7:
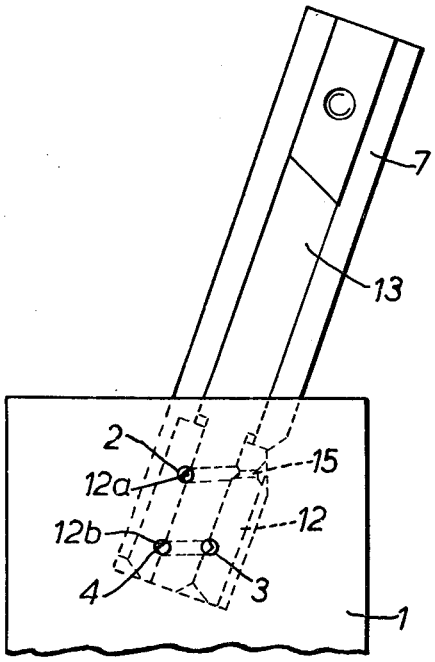
FIG. 7 is a plan view of the connector lug inserted into the wire shaping and guiding device.
Figure 8:
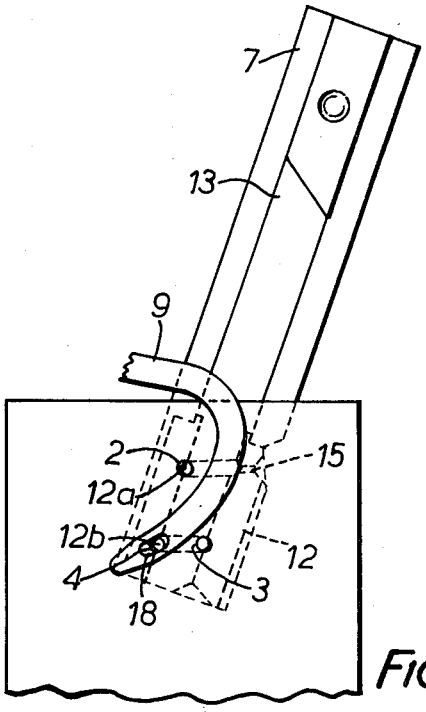
FIG. 8 is a view corresponding to FIG. 7 but with the hook-shaped needle in its operating position.

Prior to forming a coil, the connector lug 1 is inserted into the slot 8 in such manner that the aperture 2 (which is to be the first traversed by the wire 14) is situated between the exit end of the guiding groove 12*a* and the entry end of the groove 16*a*, whereas the aperture 3 (which is to be traversed next by the wire 14) is positioned between the exit end of the groove 16*a* and the entry end of the groove 12*b*, and the aperture 4 (which is to be last traversed by the wire 14) is situated at the exit end of the groove 12*b* (see FIGS. 7 and 8). This positioning of the apertures 2 to 4 assures correct threading of the wire 14 into the apertures 2 to 4 of the connector lug 1. Thus during the coil forming action, the leading end of the wire 14 is pushed consecutively into the individual apertures 2 to 4, that is, after egress from the aperture 2, the leading end of the wire 14 enters from above into the aperture 3 (FIG. 9) and continued coil forming action results in the leading end of the wire 14 entering from below into the aperture 4 (FIG. 10). Coil forming action is continued after threading of the wire 14 through the apertures 2 to 4 until approximately six turns of the coil have been formed past the aperture 4.

Prior to insertion of the leading end of the wire 14 into the aperture 2, the hook-shaped needle 9 is pivoted into its operating position illustrated in FIG. 8. The sequencing of the pivotal displacement of this needle 9 into its operating position in relation to the other operations of the wire-fastening mechanism can be controlled by means of suitable control devices as will be apparent to persons skilled in the relevant art. In its operating position shown in FIG. 8, the hook-shaped needle 9 rests on or immediately above the surface of the connector lug 1 with its eye 18 in alignment with the aperture 4 of the connector lug 1. As a consequence thereof, upon emergence of the leading end of the wire 14 from the aperture 4, the eye 18 is also traversed, so that a connection then exists between the wire coil and the needle 8.

Figure 9:
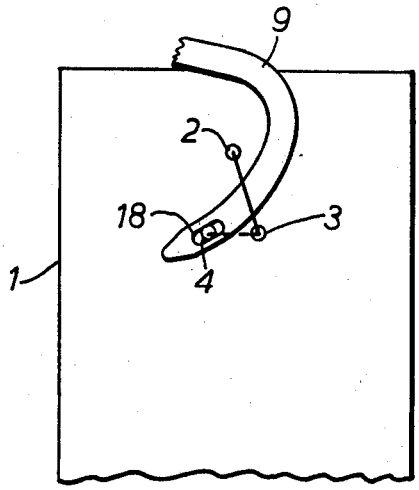
FIGS. 9 to 11 are views of the connector lug and the hook-shaped needle during successive stages in the formation of a cross loop of wire through the apertures of the connector lug.
Figure 10:
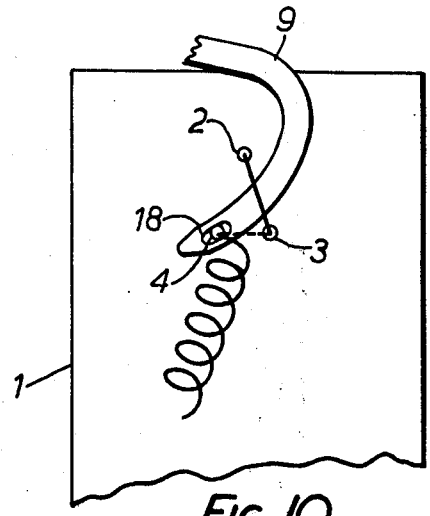

As can be seen from FIGS. 9 and 10, as the leading end of the wire 14 passes from the aperture 2 to the aperture 4, the needle 9 is crossed by the wire 14.

Figure 11:
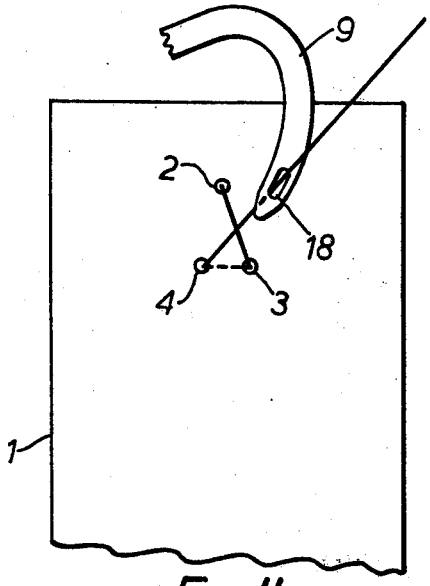

After approximately six turns have accumulated in front of the eye 18, the severing blades 19 are actuated and, at the same time, the needle 9 is pivoted anticlockwise in FIG. 10 by appropriate actuation of the rack and pinion gearing 10 and 11. As a result the wire portion consisting of the approximately six turns is pulled through (FIG. 11) by the needle 9 under the part of the wire coil extending between the two apertures 2 and 3 so that the required cross loop of wire is formed.

Figure 12:
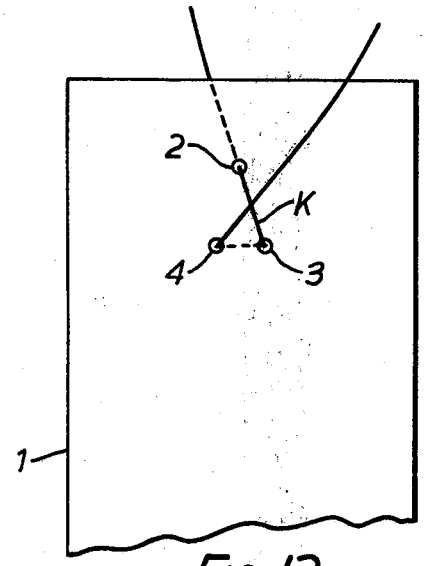
FIG. 12 is a plan view of the connector lug, with the completed wire cross loop.

FIG. 12 shows the connector lug 1 with the completed cross loop of wire.

The connector lug 1 is then removed from the device 5 by means (not shown) which, for example, constitute an ejector device.

The operation of the wire-fastening mechanism is then repeated in the hereinbefore described manner.

The described wire-fastening mechanism is advantageous in that cross loops of wire can be produced wholly automatically on connector lugs. In one form of the described mechanism approximately 4000 connector lugs have been completed per hour compared to an output of no more than approximately 250 connector lugs per hour during manual handling.

Furthermore, the comparatively thin fastening wire is prevented from missing the apertures in the connector lug (which could happen in previously proposed mechanisms due, for example, to the release of inherent strains put on the wire by the mechanism) by the form of the wire shaping and guiding device and the alignment of the apertures in the connector lug with particular elements of that device.

The provision of a needle with an eye in the described mechanism is advantageous in that the leading end of the wire of the coil is positively linked with the needle which ensures formation of the cross loop.

I claim:

1. A wire-fastening mechanism for fastening a wire to a connector lug by forming a cross loop of wire through a triangular formation of apertures in the lug, said mechanism comprising:

a support structure, a hook-shaped needle pivotably mounted on the support structure and provided with an eye, and a wire shaping and guiding device mounted on the support structure adjacent said needle, the said device comprising a first member defining a first wire-guiding groove having entry and exit ends, and a second member defining second and third wire-guiding grooves with respective entry and exit ends, said members being arranged in spaced opposition and said second, first and third grooves constituting successive half turns of a helical guide channel for wire to be formed into a coil in said device, said second groove being arranged to receive at its entry end wire to be formed into the coil, the first and second members being spaced from each other enabling the connector lug to be positioned therebetween with the apertures of said triangular formation of apertures respectively aligned between the exit end of said second groove and the entry end of the first groove, between the exit end of the first groove and the entry end of the third groove, and with the exit end of the third groove whereby wire formed into a coil by passage along said grooves is passed through the connector lug apertures, said needle being pivotable to a position between said members in which its eye is aligned with the exit end of said third groove whereby to receive the wire end emerging therefrom after passage through the corresponding aperture lug and pull that wire end beneath the wire portion in said first groove to form a cross loop of wire.

2. A wire-fastening mechanism according to claim 1, including a guiding element seated in said second member to facilitate guiding of the wire around the second and third grooves.

3. A wire-fastening mechanism according to claim 2, in which the guiding element has a guiding surface adjacent the said exit end of the third groove to guide wire exiting therefrom.

4. A wire-fastening mechanism according to claim 1, in which the said wire-guiding grooves are machined in inserts incorporated in the said first and second members.

5. A wire-fastening mechanism according to claim 1, in which the said second member defines an aperture which opens into the said entry end of the second groove whereby to facilitate wire feed into that groove.

6. A wire-fastening mechanism according to claim 2, in which the guiding element and the said first and second members are bolted together adjacent an axial end of the said helical channel remote from the said third groove.

7. A wire-fastening mechanism according to claim 1, comprising drive means arranged to pivot the said hook-shaped needle, the said drive means comprises a rack and pinion arrangement.

8. A wire-fastening mechanism for fastening a wire to a connector lug by forming a cross loop of wire through a triangular formation of apertures in the lug, said mechanism comprising:

a support structure, a hook-shaped needle pivotally mounted on the support structure and provided with an eye, and a wire shaping and guiding device mounted on the support structure adjacent said needle, the said device comprising a first member defining a first wire-guiding groove having entry and exit ends, a second member defining second and third wire-guiding grooves with respective entry and exit ends, said members being arranged in spaced opposition and said second, first and third grooves constituting successive half turns of a helical guide channel for wire to be formed into a coil in said device, said second groove being arranged to receive at its entry end wire to be formed into the coil, and a guiding element seated in said second member to facilitate guiding of the wire around the second and third grooves, the arrangement of the first and second members and guiding element being such that the connector lug can be positioned therebetween with the apertures of said triangular formation of apertures respectively aligned between the exit end of said second groove and the entry end of the first groove, between the exit end of the first groove and the entry end of the third groove, and with the exit end of the third groove whereby wire formed into a coil by passage along said grooves is passed through the connector lug apertures, said needle being pivotable to a position between said members in which its eye is aligned with the exit end of said third groove whereby to receive the wire end emerging therefrom after passage through the corresponding aperture lug and pull that wire end beneath the wire portion in said first groove to form a cross loop of wire.

* * * * *